US006582760B2

(12) United States Patent
Aschenbeck

(10) Patent No.: US 6,582,760 B2
(45) Date of Patent: Jun. 24, 2003

(54) BLEND DROP CONVEYOR FOR DEPOSITION GRANULES ONTO AN ASPHALT COATED SHEET

(75) Inventor: David P. Aschenbeck, Newark, OH (US)

(73) Assignee: Owens-Corning Fiberglas Technology, Inc., Summit, IL (US)

( * ) Notice: Subject to any disclaimer, the term of this patent is extended or adjusted under 35 U.S.C. 154(b) by 43 days.

(21) Appl. No.: 09/845,640

(22) Filed: Apr. 30, 2001

(65) Prior Publication Data

US 2002/0160108 A1 Oct. 31, 2002

(51) Int. Cl.[7] ..... B05D 1/12

(52) U.S. Cl. ..... 427/186; 427/188; 427/197; 427/199

(58) Field of Search ..... 427/186–188, 427/197, 199

(56) References Cited

U.S. PATENT DOCUMENTS

| | | | | |
|---|---|---|---|---|
| 495,795 | A | | 4/1893 | Gates |
| 810,510 | A | | 1/1906 | Robins |
| 874,982 | A | | 12/1907 | Norton |
| 1,916,095 | A | | 6/1933 | Cumfer |
| 2,000,077 | A | | 5/1935 | Harshberger |
| 2,056,274 | A | | 10/1936 | Holdsworth |
| 2,056,275 | A | | 10/1936 | Holdsworth |
| 2,074,130 | A | | 3/1937 | Penley |
| 2,157,944 | A | | 5/1939 | Walton |
| 2,303,762 | A | | 12/1942 | Reimel et al. |
| 2,661,303 | A | | 12/1953 | Fasold et al. |
| 2,905,569 | A | | 9/1959 | Zitke |
| 2,909,271 | A | | 10/1959 | Taylor |
| 3,430,753 | A | * | 3/1969 | Strang |
| 3,498,505 | A | | 3/1970 | Wirz |
| 3,603,447 | A | | 9/1971 | Pott |
| 3,730,397 | A | * | 5/1973 | Magnus |
| 4,205,745 | A | | 6/1980 | VanLingen |
| 4,270,653 | A | | 6/1981 | Densmore |
| 4,295,445 | A | | 10/1981 | Kopenhaver |
| 4,429,781 | A | | 2/1984 | Holzhauser |
| 4,478,869 | A | | 10/1984 | Brady et al. |
| 4,523,543 | A | | 6/1985 | Brady et al. |
| 4,900,589 | A | | 2/1990 | Montgomery |
| D313,101 | S | | 12/1990 | Bartholomew et al. |
| 5,361,893 | A | | 11/1994 | Lapeyre et al. |
| 5,382,291 | A | | 1/1995 | Olioso |
| 5,415,717 | A | | 5/1995 | Perneborn |
| 5,429,224 | A | | 7/1995 | Kubo |
| 5,507,383 | A | | 4/1996 | Lapyere et al. |
| 5,660,266 | A | | 8/1997 | Nolte |
| 5,728,216 | A | | 3/1998 | London |
| 5,746,830 | A | | 5/1998 | Burton et al. |
| 5,762,712 | A | | 6/1998 | Sohn |
| 5,795,389 | A | | 8/1998 | Koschitzky |
| 5,814,369 | A | | 9/1998 | Bockh et al. |
| 5,843,522 | A | | 12/1998 | Zanchetta et al. |
| 5,997,644 | A | | 12/1999 | Zickell |

FOREIGN PATENT DOCUMENTS

| | | |
|---|---|---|
| DE | 392 81 66 A1 | 3/1991 |
| DE | 422 08 72 A1 | 1/1994 |
| EP | 195 907 A2 | 10/1986 |
| WO | WO 91 07 323 A1 | 5/1991 |

* cited by examiner

*Primary Examiner*—Fred J. Parker
(74) *Attorney, Agent, or Firm*—Inger H. Eckert; James J. Dottavio

(57) ABSTRACT

A method of applying blend drop granules to an asphalt coated sheet includes moving an asphalt coated sheet in a machine direction, depositing a blend drop of granules on a blend drop conveyor that is moving at a first speed, changing the speed of the blend drop conveyor to a second speed that is closer to the speed of the moving asphalt coated sheet than is the first speed, and releasing the blend drop from the blend drop conveyor for contact with the asphalt coated sheet.

24 Claims, 5 Drawing Sheets

BLEND DROP CONVEYOR FOR DEPOSITION GRANULES ONTO AN ASPHALT COATED SHEET

TECHNICAL FIELD

This invention relates to asphalt-based roofing materials, and in particular to depositing protective and decorative shingle granules onto an asphalt coated sheet, for such uses as asphalt strip shingles.

BACKGROUND OF THE INVENTION

Asphalt-based roofing materials, such as roofing shingles, roll roofing and commercial roofing, are installed on the roofs of buildings to provide protection from the elements, and to give the roof an aesthetically pleasing look. Typically, the roofing material is constructed of a substrate such as a glass fiber mat or an organic felt, an asphalt coating on the substrate, and a surface layer of granules embedded in the asphalt coating.

A common method for the manufacture of asphalt shingles is the production of a continuous sheet of asphalt material followed by a shingle cutting operation which cuts the material into individual shingles. In the production of asphalt sheet material, either a glass fiber mat or an organic felt mat is passed through a coater containing hot liquid asphalt to form a tacky, asphalt coated sheet. Subsequently, the hot asphalt coated sheet is passed beneath one or more granule applicators which discharge protective and decorative surface granules onto portions of the asphalt sheet material.

In the manufacture of colored shingles, two types of granules are typically employed. Headlap granules are granules of relatively low cost used for the portion of the shingle which will be covered up on the roof. Colored granules or prime granules are of relatively higher cost and are applied to the portion of the shingle that will be exposed on the roof.

To provide a color pattern of pleasing appearance, the colored portion of the shingles may be provided with areas of different colors. Usually the shingles have a background color and a series of granule deposits of different colors or different shades of the background color. A common method for manufacturing the shingles is to discharge blend drops onto spaced areas of the tacky, asphalt coated sheet. Background granules are then discharged onto the sheet and adhere to the tacky, asphalt coated areas of the sheet between the granule deposits formed by the blend drops. The term "blend drop", as used herein, refers to the flow of granules of different colors or different shades of color (with respect to the background color) that is discharged from a granule blend drop applicator onto the asphalt coated sheet. The patch or assemblage of the blend drop granules on the asphalt coated sheet is also referred to as the "blend drop".

One of the problems with conventional granule application equipment is that it depends on mechanical movement to discharge blend drops onto the moving asphalt coated sheet. Usually the granules are fed from a hopper by means of a fluted roll from which, upon rotation, the granules are discharged onto the sheet. The roll is ordinarily driven by a drive motor, and the roll rotation is started and stopped by means of a brake-clutch mechanism. The requirement for mechanical action has inherent limitations which prevent a very precise beginning and ending to the blend drop. Also, once the mechanical action takes place, there is a short time lag as the inertia of the granules is overcome. Consequently, there is a limit to the sharpness of the blend drops on the shingle. As shingle manufacturing lines go up in speed, the lack of sharpness is accentuated and the distinction between the blend drop granule deposits, and the background color becomes fuzzy. The lack of sharpness puts a severe limitation on the kinds of patterns and color contrasts that can be applied to shingles at high production speeds.

A known granule depositing method designed to overcome the sharpness problem of conventional granule applicators is shown in U.S. Pat. No. 5,795,389 issued to Koschitzky. The Koschitzky reference discloses an auxiliary belt traveling above the asphalt coated sheet. A series of rectangular openings in the belt allow granules dropping on the belt to drop through the belt to form straight edge blend drops because stray granules will not pass through the belt, but will be carried away. However, the granules being dropped onto the asphalt coated sheet in this method have zero forward velocity, and considerable bouncing and scattering of the granules, and therefore fuzzy edges, would be expected. Further, the apparatus in the Koschitzky patent does not offer any opportunity to react to changes in the speed of the asphalt coated sheet. The length and spacing of the blend drops from the Koschitzky transfer belt are fixed by the length and spacing of the openings in the belt, and the openings cannot be changed during production without changing the belt.

In an alternative embodiment, the Koschitzky reference discloses that the auxiliary belt includes an upper flight and a lower flight, with the upper flight travelling in a direction opposite that of the asphalt coated sheet. At the upstream end of the auxiliary belt (i.e., upstream with respect to the movement of the asphalt coated sheet) the upper flight of the auxiliary belt turns around a belt roller to form the lower flight. A retaining conveyor is wrapped around the upstream end of the auxiliary conveyor to keep the granules from flying about as the granules are turned into a downward direction. The granules of each of the patches are dropped vertically straight down onto the asphalt coated sheet to form blend drops. After the blend drops are applied to the asphalt coated sheet the background granules are applied to form a granule coated sheet, which is then cooled and cut into individual granule coated shingles.

While the retaining conveyor disclosed in the Koschitzky patent is able to successfully turn down the granules from the auxiliary conveyor, as the vertically moving granules make impact with the moving asphalt coated sheet, a significant portion of the granules bounce on the sheet, landing downstream and thereby causing fuzzy blend drop edges rather than sharply defined leading and trailing edges for the blend drop. This problem is magnified when the asphalt coated sheet is operated at high speeds. Also, in a manner similar to the first embodiment disclosed in the Koschitzky patent, there in no opportunity to react to changes in the speed of the asphalt coated sheet, and the length and spacing of the blend drops are fixed by the length and spacing of the openings in the belt, which cannot be changed during production without changing the belt.

U.S. Pat. No. 5,814,369 to Bockh et al. discloses another blend drop granule applicator having an applicator roll positioned to rotate directly above a moving asphalt coated sheet. Granules corresponding to a desired blend drop are deposited onto the applicator roll at the top of the rotation, and when the applicator roll rotates approximately 180 degrees the blend drop falls off onto the asphalt coated sheet when the blend drop reaches the bottom of the rotation. A media retaining belt engages the applicator roll, contacting and wrapping around the applicator roll to hold the blend drop granules on the surface of the applicator roll until the applicator roll rotates about 180 degrees. At the point where the media retaining belt stops contacting or becomes disengaged from the applicator roll, the blend drop granules are released to drop onto the moving asphalt coated sheet to form the blend drop. The Bockh et al. patent states that the distance that the granules fall from the applicator roll to the asphalt coated sheet should be minimized. The Bockh et al. patent further states that the linear speed of the applicator roll should be synchronized with that of the moving asphalt coated sheet so that the granules can be dropped precisely in the desired pattern.

A limitation with the process disclosed in the Bockh et al. patent is that it only works at relatively low line speeds, such as, for example, below 300 feet per minute. At higher line speeds one would expect the granules to fly out of the pockets due to centrifugal force. Further, since the pockets are fixed on the fixed size drum, there is no flexibility to alter the cycle pattern without replacing the drum. The drum can be sped up to accommodate increases in the speed of the asphalt coated sheet, but the length of spacing between blend drops cannot be changed while maintaining the drum speed equal to the speed of the asphalt coated sheet.

It would be advantageous if there could be developed a shingle blend drop technique that enables blend drops to be accurately placed on a moving asphalt coated sheet with sharply defined edge definition at high operating speeds. Ideally, the technique would allow the size and shape, i.e., the appearance, of the blend drop to be identical to the desired appearance regardless of the speed of the moving asphalt coated sheet. Further, the length and spacing of the blend drops in the machine direction should be independently adjustable without physically changing the equipment.

SUMMARY OF THE INVENTION

The above objects as well as other objects not specifically enumerated are achieved by a method of applying blend drop granules to an asphalt coated sheet including moving an asphalt coated sheet in a machine direction, depositing a blend drop of granules on a blend drop conveyor that is moving at a first speed, changing the speed of the blend drop conveyor to a second speed that is closer to the speed of the moving asphalt coated sheet than is the first speed, and releasing the blend drop from the blend drop conveyor for contact with the asphalt coated sheet.

According to this invention there is also provided a method of applying blend drop granules to an asphalt coated sheet including moving an asphalt coated sheet in a machine direction, depositing a blend drop of granules on a blend drop conveyor that is stationary, accelerating the blend drop conveyor to a speed that approximates the speed of the moving asphalt coated sheet, and releasing the blend drop from the blend drop conveyor for contact with the asphalt coated sheet.

According to this invention there is also provided a method of applying blend drop granules to an asphalt coated sheet including moving an asphalt coated sheet in a machine direction, providing a blend drop conveyor that has a surface having a plurality of cells for containing the blend drop granules, depositing a blend drop of granules on the blend drop conveyor, and releasing the blend drop from the blend drop conveyor for contact with the asphalt coated sheet.

According to this invention there is also provided apparatus for applying blend drop granules to an asphalt coated sheet, where the apparatus includes a blend drop conveyor for receiving blend drop granules and releasing the blend drop granules for contact with the asphalt coated sheet. The blend drop conveyor is positioned above the asphalt coated sheet, and the blend drop conveyor has a driving means for driving the conveyor. A blend drop applicator is positioned above the blend drop conveyor for feeding blend drop granules to the blend drop conveyor. A controller is adapted to send a signal to the driving means to drive the blend drop conveyor at a first speed when the blend drop applicator is feeding blend drop granules to the blend drop conveyor, and adapted to send a different signal to the driving means to drive the blend drop conveyor at a second speed after the blend drop granules are positioned on the blend drop conveyor.

According to this invention there is also provided apparatus for applying blend drop granules to an asphalt coated sheet, where the apparatus includes a blend drop conveyor for receiving blend drop granules and releasing the blend drop granules for contact with the asphalt coated sheet. The blend drop conveyor is positioned above the asphalt coated sheet, and the blend drop conveyor has a plurality of cells for containing the blend drop granules.

Various objects and advantages of this invention will become apparent to those skilled in the art from the following detailed description of the preferred embodiments, when read in light of the accompanying drawings.

DETAILED DESCRIPTION OF THE INVENTION

Figure 1:
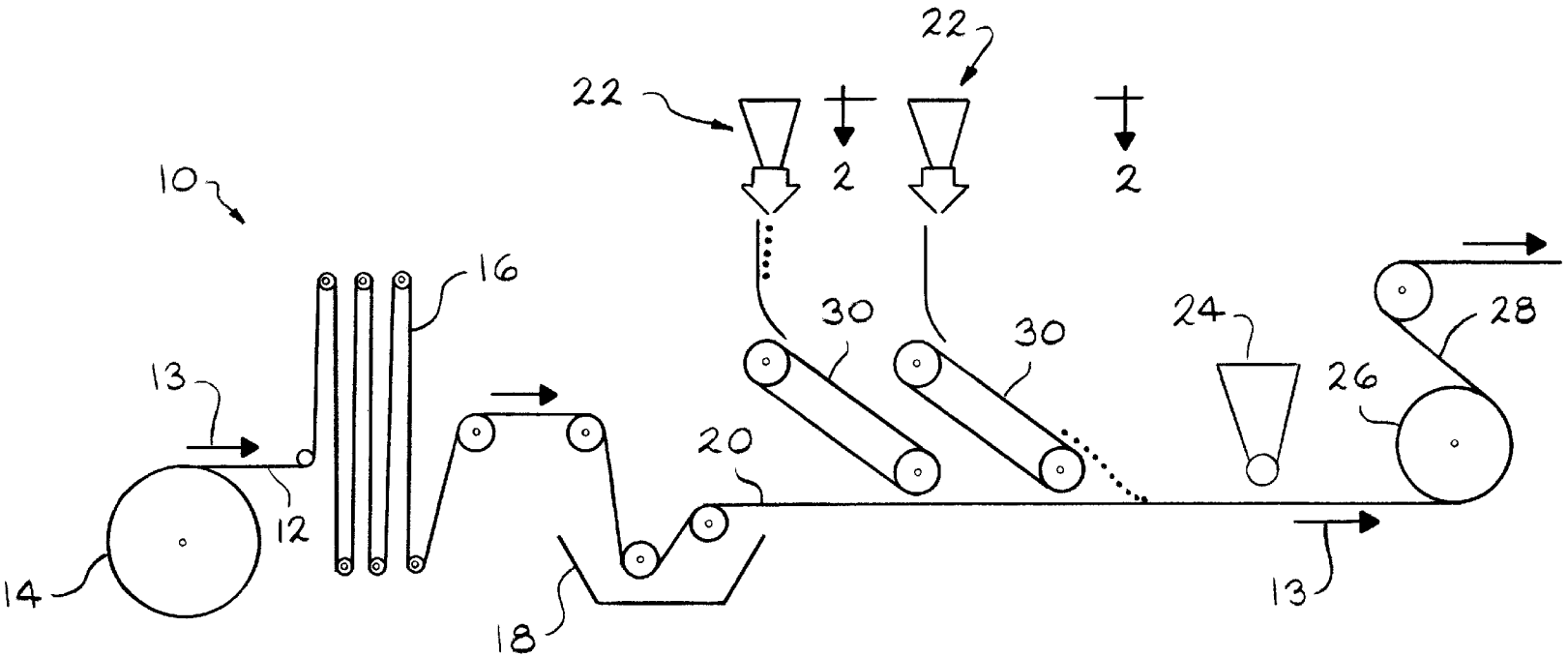
FIG. 1 is a schematic view in elevation of apparatus for manufacturing an asphalt-based roofing material according to the invention.

Referring now to the drawings, there is shown in FIG. 1 an apparatus 10 for manufacturing an asphalt-based roofing material according to the invention. The illustrated manufacturing process involves passing a continuous sheet or substrate 12 in a machine direction 13 through a series of manufacturing operations. The sheet usually moves at a speed of at least about 200 feet/minute (61 meters/minute), and typically at a speed within the range of between about 450 feet/minute (137 meters/minute) and about 800 feet/minute (244 meters/minute).

In a first step of the manufacturing process, the continuous sheet 12 of substrate is payed out from a roll 14. The substrate can be any type known for use in reinforcing asphalt-based roofing materials, such as a web, scrim or felt of fibrous materials such as mineral fibers, cellulose fibers, rag fibers, mixtures of mineral and synthetic fibers, or the like. Combinations of materials can also be used in the substrate. Preferably, the substrate is a nonwoven wet process mat or web of glass fibers.

The sheet of substrate is passed from the roll through an accumulator 16. The accumulator allows time for splicing one roll of substrate to another, during which time the substrate within the accumulator is fed to the manufacturing process so that the splicing does not interrupt manufacturing.

Next, the sheet is passed through a coater 18 where an asphalt coating is applied to the sheet to form an asphalt coated sheet 20. The asphalt coating can be applied in any suitable manner. In the illustrated embodiment, the sheet is submerged in a supply of hot, melted asphalt coating to completely saturate and cover the sheet with the tacky coating. However, in other embodiments, the asphalt coating could be sprayed on, rolled on, or applied to the sheet by other means. When an organic felt is used as the substrate, it may be desirable to first saturate the felt with a saturant asphalt, and then coat the upper and lower surfaces of the felt with an asphalt coating containing a filler. The asphalt used in coating the sheet 12 can be any type of bituminous material suitable for use on a roofing material, such as asphalts, tars, pitches, or mixtures of these materials. The asphalt coating can include various additives and/or modifiers, such as inorganic fillers or mineral stabilizers, organic materials such as polymers, recycled streams of materials, or ground tire rubber. Preferably, the asphalt coating contains an asphalt and an inorganic filler.

The asphalt coated sheet 20 is passed beneath two blend drop application stations indicated generally at 22, where blend drop granules are applied to the asphalt coated sheet. Although two blend drop application stations 22 are shown, it is to be understood that more or less than two blend drop application stations can be used. Also, each of the blend drop application stations 22 can be adapted to supply more than one stream of blend drops, or blend drops of different colors, shading or size.

The asphalt coated sheet 20 is then passed beneath a background granule dispenser 24 for the application of background granules. After the introduction of the background granules, the sheet is turned around a slate drum 26 to press the granules into the asphalt coating and to temporarily invert the sheet to allow excess granules to drop off. The granule coated sheet 28 is then cooled, cut and packaged in any suitable manner, not shown. The cooling, cutting and packaging operations are well known in the art.

Figure 2:
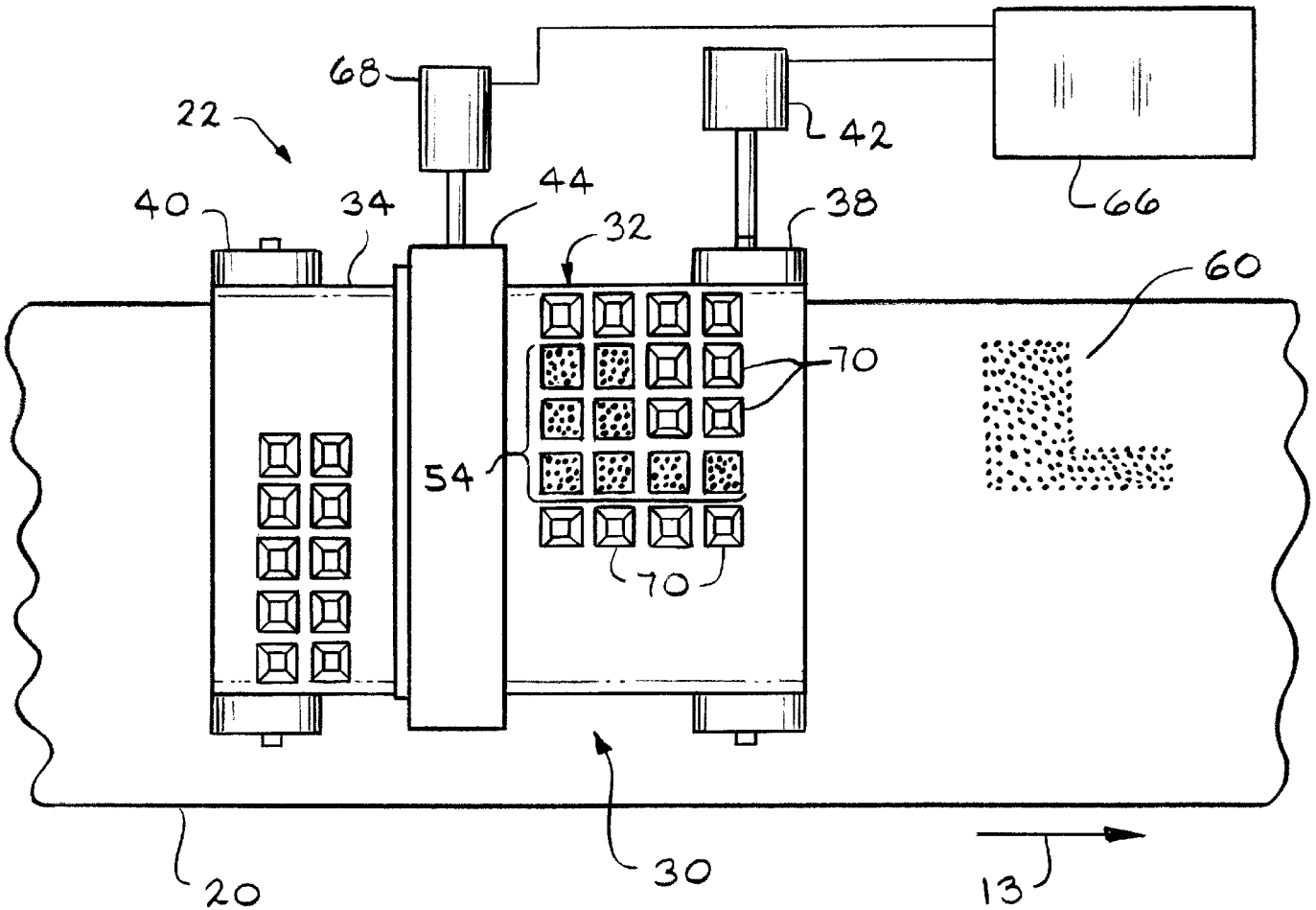
FIG. 2 is an enlarged schematic plan view of the blend drop application station of the invention, taken along line 2—2 of FIG. 1.
Figure 3:
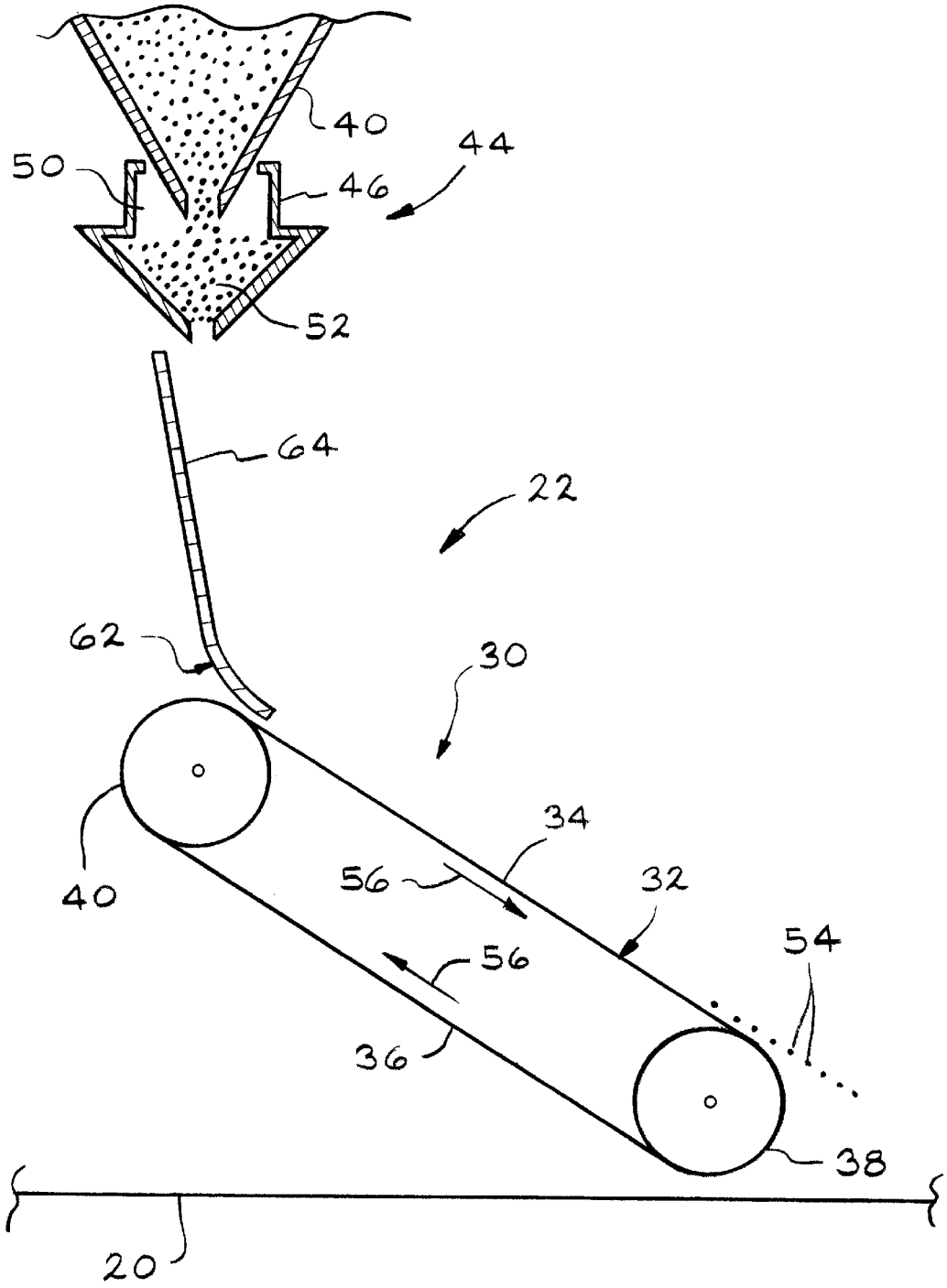
FIG. 3 is a view in elevation of a blend drop application station.

As shown in FIGS. 2 and 3, the blend drop application station 22 includes a blend drop conveyor 30 having a belt 32 with an upper flight 34 and a lower flight 36. The belt 32 travels around a forward roller 38 and a rear roller 40 which separate or space apart the upper flight 34 and the lower flight 36. The blend drop conveyor receives blend drop granules and releases them onto the asphalt coated sheet. The granules are released by having the upper flight 34 of the belt turn around the forward roller 38 while the inertia of the granules carries the granules directly into contact with asphalt coated sheet. The blend drop conveyor is preferably oriented at an acute angle to the asphalt coated sheet 20. More preferably, the blend drop conveyor 30 is mounted at about a 30 degree angle with respect to the blend drop conveyor. As the granules impact the asphalt coated sheet, they have a forward component of velocity and a downward component of velocity. The downward component of velocity helps embed the granules into the asphalt coated sheet. The forward component of velocity helps assure minimal scattering of the blend drop granules. At a 30 degree incline, the forward component of the velocity is 87 percent of the total velocity of the patch 54 of granules on the blend drop conveyor.

The blend drop conveyor is operated by a motor 42, with the upper flight 34 traveling generally in the machine direction 13, and the lower flight 36 traveling in the opposite direction. Although numerous types of motor can be used to operate the conveyor 30, a preferred motor is a servo-motor, which allows rapid changes in the speed of the blend drop conveyor.

Another significant element of the blend drop application station 22 is a granule feeding apparatus, such as blend drop applicator 44, shown in cross-section in FIG. 3. The blend drop applicator is positioned above the upper flight 34, and it includes a nozzle 46 and a hopper 48. A pneumatic device, not shown, changes the pressure in the air chamber 50 to instantaneously start and stop the flow of granules 52 from the nozzle 46. Pneumatically assisted blend drop applicators are known to those skilled in the art. The opening of the nozzle 46 causes a flow or stream of blend drop granules to drop toward the upper flight 34. The nozzle is controlled to allow the flow of granules to have a definite or finite beginning and ending, and the resulting collection or assemblage of granules on the upper flight 34 is a blend drop granule patch 54. The blend drop conveyor belt is operated by the motor 42 to move the belt in the direction indicated by the directional arrows 56, and the blend drop granules in the blend drop granule patch 54 are released for contact with the asphalt coated sheet 20, forming a blend drop 60 on the asphalt coated sheet.

In accordance with one embodiment of the invention, the belt 32 is operated by the motor 42 in such an manner that the blend drop conveyor 30 is moving at a first speed when the blend drop granules are deposited on the blend drop conveyor, and then the speed of the blend drop conveyor is changed so that the speed becomes closer to the speed of the asphalt coated sheet 20. After the speed of the blend drop conveyor is changed to more nearly approximate the speed of the asphalt coated sheet, the blend drop granules are released from the blend drop conveyor for contact with the asphalt coated sheet, as shown in FIG. 3. In most circumstances it is advantageous to apply the blend drop granules to the blend drop conveyor at a first speed and then to increase the speed of the blend drop conveyor to a speed that is closer to, if not substantially equal to, the speed of the asphalt coated sheet before releasing the blend drop granules. For purposes of this invention, the term "approximates the speed of the asphalt coated sheet" means that the blend drop conveyor reaches a speed that a) differs from the speed of the asphalt coated sheet by an amount that is less than 300 feet per minute, or b) differs from the speed of the asphalt coated sheet by an amount that is less than 20 percent of the speed of the asphalt coated sheet. The term "approximates the speed of the asphalt coated sheet" also includes the case where the speed of the blend drop conveyor equals the speed of the asphalt coated sheet. Ideally, the difference in speed is less than 150 feet per minute.

In general, when depositing granules onto conveyors or onto asphalt coated sheets, the sharpness of the blend drop can be a function of the conveyor speed. At a relatively low conveyor speed of about 250 feet per minute a high quality, sharply defined blend drop can be deposited onto the conveyor, whereas at higher speeds the blend drop becomes fuzzy. Therefore, the blend drop conveyor is operated at a relatively low speed during the depositing of the blend drop granules onto the conveyor. Ideally, the blend drop conveyor is run at a repeated, constant speed during the depositing of the blend drop granules so that each patch 54 of blend drop granules will be consistent. Also, it is advantageous to introduce the blend drop granules to the blend drop conveyor at a speed that is nearly equal to the speed of the blend drop conveyor. To this end, it is preferable to drop the blend drop granules from the blend drop applicator 44 at a height above the blend drop conveyor 20 that will result in granule speed (due to gravitational acceleration) approximating the speed of the blend drop conveyor.

The blend drop application station 22 is provided with a deflector 62 for changing the direction of the downwardly moving blend drop granules so that they are introduced to the blend drop conveyor at a very low angle with respect to the surface of the upper flight. The deflector can be any device suitable for changing the direction of the granules, such as, for example, a mechanical or a pneumatic device. Another optional structural element that can be useful with the invention is an upwardly extending impact surface 64 that is positioned to prevent scattering of the blend drop granules as they move from the blend drop applicator 44 to the blend drop conveyor. The impact surface 64 and the deflector are preferably formed as one element. The impact surface is preferably at a slight angle with respect to the vertical, such as, for example, about 5 degrees from the vertical, to intercept the granules. The impact surface has a greater practical value where the blend drop applicator is of a type that causes significant scattering of the blend drop granules.

An important aspect in using a blend drop conveyor to apply blend drop granules to the asphalt coated sheet is providing a capacity to rapidly change the speed of the blend drop conveyor 30. If, for example a five foot total length is chosen for the belt 32, the operating length 34 of the upper flight will be about two feet long. At a relatively low blend drop conveyor speed of about 250 feet per minute a high quality, sharply defined blend drop can be deposited onto the blend drop conveyor. After the blend drop granules have been deposited on the blend drop conveyor, the speed of the blend drop conveyor is increased to a higher speed, such as, for example, 500 feet per minute. If, for example the asphalt coated sheet is traveling at 600 feet per minute, the increased speed of the blend drop conveyor (500 feet per minute) would more closely approximate the speed of the asphalt coated sheet. With the blend drop granules released from the blend drop conveyor at a speed close to the speed of the asphalt coated sheet, there is less scatter of the blend drop granules, and therefore a more sharply defined blend drop 60 on the asphalt coated sheet.

While there may be situations where the second speed of the blend drop conveyor is actually slower than the first speed of the blend drop conveyor, the second speed will typically be higher than the first speed because of the usual high speed of the asphalt coated sheet. The amount of increase in speed of the blend drop conveyor from the first speed to second speed without smearing the granules will vary for several reasons, including the type of blend drops being applied, the length of the blend drop conveyor, the recycle time (minimum time between blend drops), the initial speed of the blend drop conveyor, and the speed of the asphalt coated sheet. Preferably the apparatus of the invention is adapted to increase the speed by a factor of at least two, and in some embodiments of the invention, by a factor of at least four.

After the blend drop conveyor releases the patch 54 of blend drop granules for contact with the asphalt coated sheet, the blend drop conveyor must be slowed down to be ready for the next deposit of blend drop granules. The time for a complete cycle of depositing granules on the blend drop conveyor, increasing the speed of the conveyor, releasing the patch of blend drop granules, and slowing the speed of the conveyor will depend on several factors, including the propensity of the granules to move on the belt 32 during acceleration of the belt, and the desired final speed of the blend drop conveyor. The cycle may have a duration of about one second, although longer or shorter cycles can also be used.

In order to achieve the proper increase and decrease in speed of the blend drop conveyor, the conveyor motor 42 is connected to a controller 66, which can be a computer. The controller is also connected to a motor 68 for operating the blend drop applicator 44. The controller receives a signal, from a source not shown, indicative of the speed of the asphalt coated sheet. The controller provides a signal to the blend drop conveyor motor 42 to control the speed of the blend drop conveyor. Further, the controller provides a signal to the blend drop applicator motor 68 to initiate another blend drop deposit. It is to be understood that the controller could use an internally calculated value for the speed of the asphalt coated sheet rather than a measured value. It can be seen that the controller controls the depositing of the blend drop granules onto the blend drop conveyor, and controls the speed of the blend drop conveyor, in response to the speed of the asphalt coated sheet. In a specific application, the controller is adapted to send a signal to the driving means to drive the blend drop conveyor at a first speed when the blend drop applicator is feeding blend drop granules to the blend drop conveyor, and adapted to send a different signal to the driving means to drive the blend drop conveyor at a second speed after the blend drop granules are positioned on the blend drop conveyor.

In accordance with another aspect of the invention, the belt 32 of the blend drop conveyor 30 includes a plurality of cells 70 that cover the surface of the belt 32. As shown in FIGS. 2 and 4–6, the cells 70 have an open top and are hollow so that they can receive and transport granules that are dropped onto the belt. Although the cells can have any shape suitable for containing the granules, the cells preferably have a square or rectangular shape. By selecting a square or rectangular shape for the cells, generally rectangular shapes for the blend drop granule patches 54 and for the blend drops 60 can more be readily formed. In order to assure that the granules will relatively easily flow out of the cells when it's time to release the blend drops from the blend drop conveyor, the hollow interior of the cells is preferably provided with beveled interior edges 72. The angle of the bevel can be any suitable angle, such as about 10 degrees. The beveling of the sides of the cell precludes the possibility of having a significant number of granules sticking to the interior of the cells.

Although any shape and size can be used for the cells, a preferred depth of the cells is within the range of from about one-eighth inches to about one-fourth inches, and the area of the opening at the top of the cell is preferably within the range of from about one-thirty-second to about one-half inches square. The cells should be sized to contain the required amount of granules for the blend drop. Extra depth or capacity must be provided to accommodate the shifting of the granules during the rapid acceleration of the granules while on the belt 32. Ideally, the cells are shaped to handle an acceleration of at least 2g (i.e., at least two times the acceleration of gravity) when filled halfway with granules.

Figure 4:
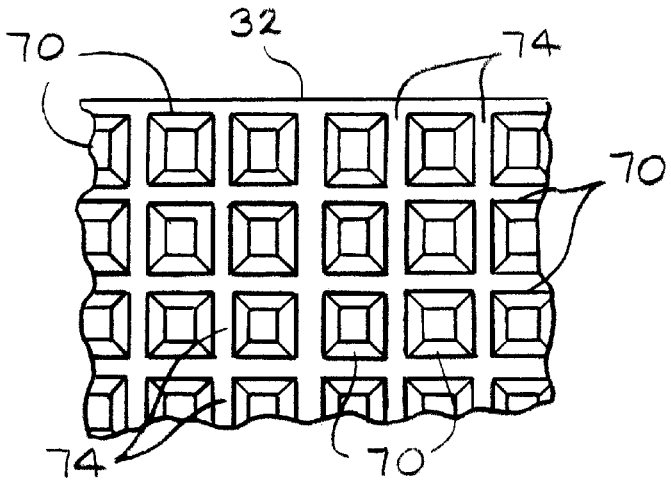
FIG. 4 is a schematic plan view of the blend drop conveyor of the invention.
Figure 5:
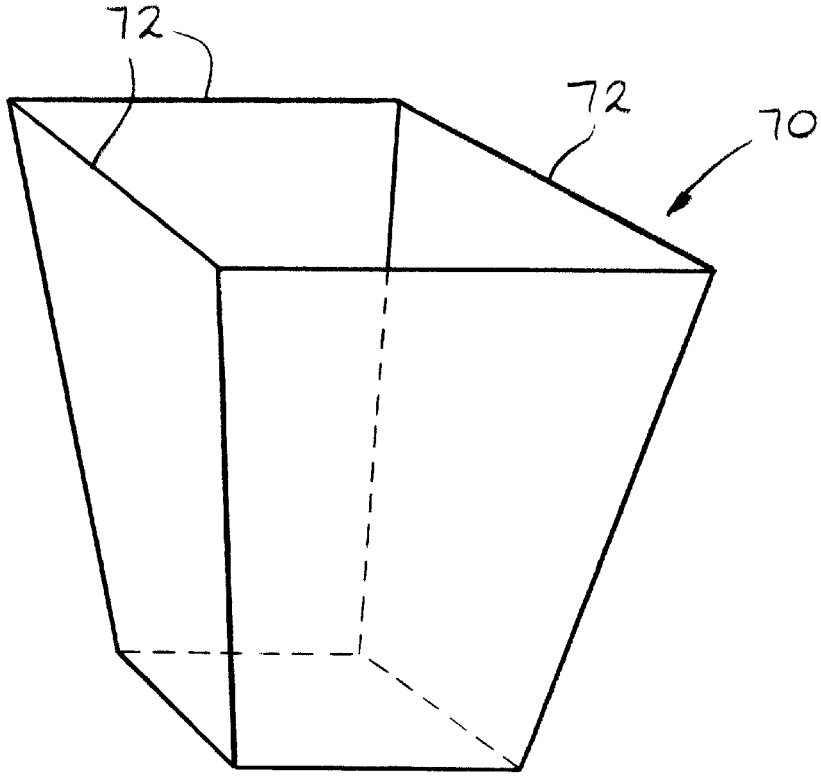
FIG. 5 is a schematic perspective view of a single cell of the blend drop conveyor of the invention.
Figure 6:
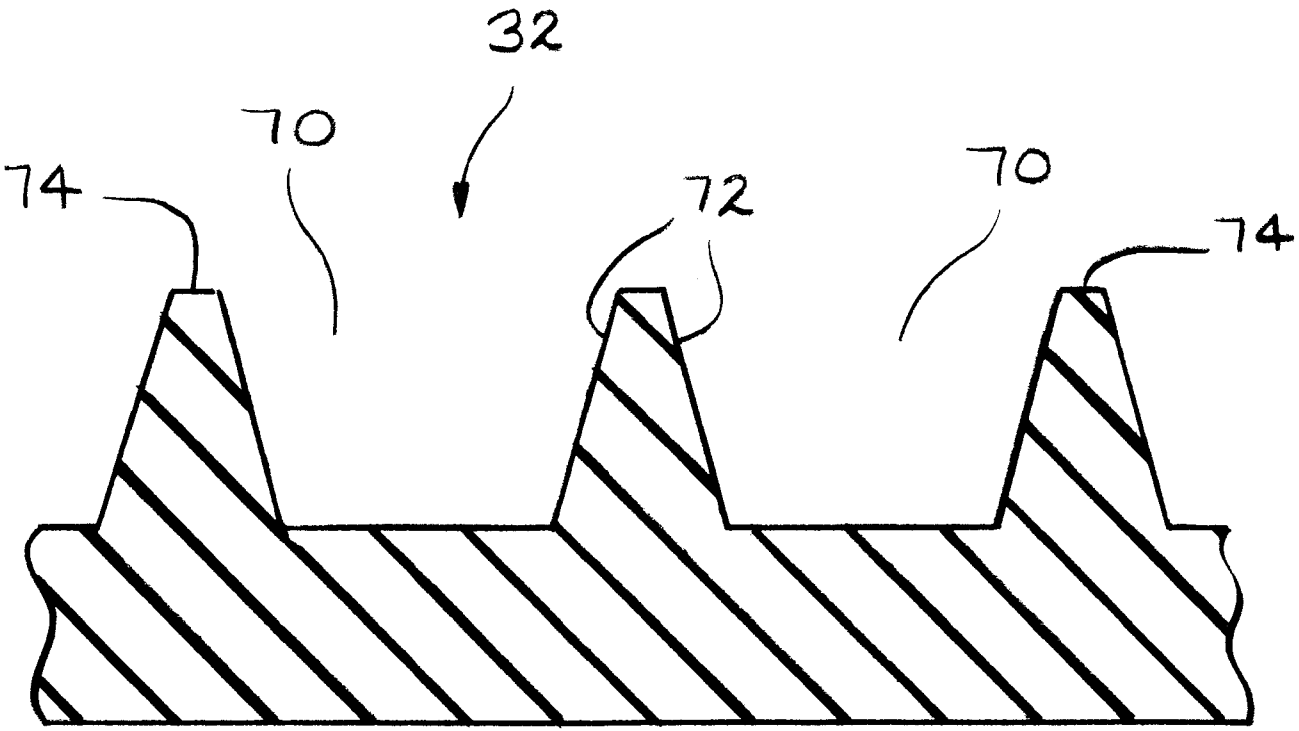
FIG. 6 is a cross-sectional view in elevation of a portion of the belt of the blend drop conveyor.

It can be seen from FIGS. 4 and 6 that adjacent cells are separated by lands 74. A most preferred size (area) for the cells is one-fourth by one-fourth inches, including the lands 74, with a depth of about three-sixteenths inches for the interior of the cells. The walls of the cells are beveled, as shown in FIG. 6, to provide a tapered interior and to contribute to the overall strength of the belt 32. The belt itself can be made of any semiflexible material capable of being driven as a continuous belt. Alternatively, a link belt of sections of a rigid material can be used. A preferred material for the belt is a urethane material, which can be cast or molded using a mold, not shown, to provide the cells in the surface. Other materials such as rubber can be used.

While the shape of the cells is shown as being generally rectangular, it is to be understood that the cells can be set at angles to the machine direction, and can be made in other shapes, such as curved shapes and triangles. Even though only a single blend drop 60 is shown in FIG. 2, it is to be understood that several blend drops 60 would normally be positioned simultaneously across the width of the asphalt coated sheet 20 to reflect the fact that multiple shingles are being made at the same time, such as in a three-wide machine. While a single blend drop applicator 44 is shown as being associated with the blend drop conveyor 30, it is to be understood that two or more applicators 44 can be used with a single, celled, blend drop conveyor. Since the belt 32 contains cells across its entire surface, the shape of the collection of falling granules dropping onto the belt from the blend drop applicator will result in a corresponding collection of cells containing granules on the belt 32, and this will result in a correspondingly similar shape for the blend drop 60 on the asphalt coated sheet. Each of the applicators could be adapted to deposit patches of blend drop granules that have different shapes from each other. For example, a first blend drop applicator or first granule feeding apparatus 44 and a second blend drop applicator or second granule feeding apparatus 44 could be adapted to provide a first blend drop pattern and a second blend drop pattern, respectively. Therefore, a single belt 32 could by used with two different applicators 44, one producing a first blend drop pattern and one producing a second, different blend drop pattern.

Although the conveyor 30 is shown as being an endless belt 32 driven around rollers 38 and 40, the invention can be practiced using a conveyor having a reciprocating plate or surface, not shown, containing a plurality of the cells 70. The plate would be mounted to receive a patch of blend drop granules and then accelerate to a speed approximating or matching the speed of the asphalt coated sheet. An abrupt deceleration of the plate would release the blend drop granules for contact with the asphalt coated sheet. Regardless of whether the conveyor 30 has a continuous belt 32 or a reciprocating plate, the invention can be practiced with the belt or plate moving at ultralow speeds, such as, for example, less than 100 feet per minute, or even stationary, during the depositing of the granules on the conveyor. Then, the belt or plate is accelerated before releasing the granules for contact with the asphalt coated sheet.

The pneumatically actuated blend drop applicator 44 shown in FIG. 3 is only one of many types of granule feeding apparatus that can be used with the invention. Since the blend drop conveyor is traveling slowly while it is receiving the blend drop granules, relatively unsophisticated blend drop applicators can be used. For example, a reciprocating slot actuator, not shown, such as that disclosed in U.S. Pat. No. 5,858,095 can also be used. While the slot is shown in the patent as being reciprocated linearly, it would be possible to arrange the slot on the circumference of a rotating body for a rotary motion rather than a reciprocating motion. An additional applicator that can be used for the invention is a conventional fluted roll, not shown.

The blend drop applicator 44, which is a type of granule feeding apparatus, has been described as being part of the blend drop application station 22. As shown in FIG. 1, there can be more than one blend drop application station. Each blend drop application station can include a blend drop applicator and a blend drop conveyor. Since the blend drop conveyors are arranged at an acute angle to the asphalt coated sheet, the blend drop application stations can be nested to conserve space. Therefore, it can be seen that in addition to the first blend drop application station, there can be one or more additional blend drop application stations (e.g. a second blend drop application station) including a second blend drop applicator positioned above a second blend drop conveyor for feeding blend drop granules to the asphalt coated sheet.

The principle and mode of operation of this invention have been described in its preferred embodiments. However, it should be noted that this invention can be practiced otherwise than as specifically illustrated and described without departing from its scope.

What is claimed is:

1. A method of applying patches of blend drop granules to an asphalt coated sheet comprising:

moving an asphalt coated sheet in a machine direction;

depositing a blend drop of granules on a blend drop conveyor that is moving at a first speed;

after said step of depositing said granules on said blend drop conveyor, thereafter changing a speed of the blend drop conveyor to a second speed that approximates the speed of the moving asphalt coated sheet than is the first speed; and releasing the blend drop from the blend drop conveyor for contact with the asphalt coated sheet to form a patch of blend drop granules on the sheet, and reducing the speed of the blend drop conveyor prior to depositing another blend drop of granules thereon.

2. The method of claim 1 in which the second speed is substantially equal to the speed of the asphalt coated sheet.

3. The method of claim 1 in which second speed is faster than the first speed.

4. The method of claim 1 in which the blend drop conveyor returns to the first speed after the blend drop is released.

5. The method of claim 1 in which the belt has cells on its surface to define a shape of the blend drop on the blend drop conveyor.

6. The method of claim 1 in which a controller controls the depositing of the blend drop granules onto the blend drop conveyor, and controls the second speed of the blend drop conveyor, in response to the speed of the asphalt coated sheet.

7. The method of claim 1 in which the blend drop granules are deposited on the asphalt coated sheet as a blend drop that is in a shape that is not square or rectangular.

8. The method of claim 1 in which the step of changing the speed of the blend drop conveyor to a second speed involves accelerating the blend drop conveyor to a speed that is within about 150 feet per minute of the speed of the moving asphalt coated sheet.

9. The method of claim 1 in which the step of changing the speed of the blend drop conveyor to a second speed involves accelerating the blend drop conveyor to a speed that is substantially the same as the speed of the moving asphalt coated sheet.

10. A method of applying patches of blend drop granules to an asphalt coated sheet comprising:

moving an asphalt coated sheet in a machine direction;

depositing a blend drop of granules on a blend drop conveyor that is stationary;

after said step of depositing said granules on said blend drop conveyor, thereafter accelerating the blend drop conveyor to a speed that approximates a speed of the moving asphalt coated sheet; and releasing the blend drop from the blend drop conveyor for contact with the asphalt coated sheet, to form a patch of blend drop granules on the sheet, and reducing the speed of the blend drop conveyor prior to depositing another blend drop of granules thereon.

11. A method of applying blend drop granules to an asphalt coated sheet comprising:

moving an asphalt coated sheet in a machine direction;

providing a blend drop conveyor that has a surface having a plurality of cells for containing the blend drop granules, the cells being shaped to handle an acceleration of at least two times the acceleration of gravity when filled halfway with granules;

depositing a blend drop of granules on the blend drop conveyor; and releasing the blend drop from the blend drop conveyor for contact with the asphalt coated sheet.

12. The method of claim 11 in which the cells cover substantially all of the surface of the blend drop conveyor.

13. The method of claim 11 in which the cells have a depth within the range of from about one-eighth inch to about one-fourth inch.

14. The method of claim 11 in which the cells have an area within the range of from about one-thirty-second to about one-half inches square.

15. The method of claim 11 in which the cells have beveled edges.

16. The method of claim 11 in which the step of depositing the blend drop of granules on the blend drop conveyor includes generating a downwardly moving blend drop of granules, and intercepting the downwardly moving blend drop of granules with the blend drop conveyor.

17. The method of claim 11 in which the step of depositing the blend drop of granules on the blend drop conveyer is accomplished while the blend drop conveyor is moving at a first speed, and the speed of the blend drop conveyor is subsequently change to a second speed, and the speed of the moving asphalt coated sheet.

18. A method of applying blend drop granules to an asphalt coated sheet comprising:

moving an asphalt coated sheet in a machine direction;

providing a blend drop conveyor that has a surface having a plurality of cells for containing the blend drop granules;

depositing a blend drop of granules on the blend drop conveyor, wherein a first blend drop pattern is provided by a first granule feeding apparatus, and a second blend drop pattern is provided by a second granule feeding apparatus, with both the first granule feeding apparatus and the second granule feeding apparatus using the same blend drop conveyor; and releasing the blend drop from the blend drop conveyor for contact with the asphalt coated sheet.

19. The method of claim 18 which the cells cover substantially all of the surface of the blend drop conveyor.

20. The method of claim 18 in which the cells have a depth within the range of from about one-eighth inch to about one-fourth inch.

21. The method of claim 18 in which the cells have an area within the range of from about one-thirty-second to about one-half inches square.

22. The method of claim 18 in which the cells have beveled edges.

23. The method of claim 18 in which the step of depositing the blend drop of granules on the blend drop conveyor includes generating a downwardly moving blend drop of granules, and intercepting the downwardly moving blend drop of granules with the blend drop conveyor.

24. The method of claim 18 in which the step of depositing the blend drop of granules with the blend drop conveyor is accomplished while the blend drop conveyor is moving at a first speed, and the speed of the blend drop conveyor is subsequently changed to a second speed that approximates the speed of the moving asphalt coated sheet.

* * * * *